US006450237B1

(12) United States Patent
Meyer et al.

(10) Patent No.: US 6,450,237 B1
(45) Date of Patent: Sep. 17, 2002

(54) COMPOUND CAST PRODUCT AND METHOD FOR PRODUCING A COMPOUND CAST PRODUCT

(76) Inventors: Thomas N. Meyer, 3987 Murray Highlands Cir., Murrysville, PA (US) 15668-1747; Srinath Viswanathan, 1104 Albermarle La., Knoxville, TN (US) 37923

( * ) Notice: Subject to any disclaimer, the term of this patent is extended or adjusted under 35 U.S.C. 154(b) by 0 days.

(21) Appl. No.: 09/824,560

(22) Filed: Apr. 2, 2001

(51) Int. Cl.[7] ..... B22D 37/00; B22D 17/00; B22D 19/16

(52) U.S. Cl. ..... 164/135; 164/119; 164/91

(58) Field of Search ..... 164/135, 119, 164/306, 337, 93, 95, 91

(56) References Cited

U.S. PATENT DOCUMENTS

| | | | | |
|---|---|---|---|---|
| 3,752,212 A | | 8/1973 | Thompson | 164/93 |
| 3,847,203 A | | 11/1974 | Northwood | 164/60 |
| 5,000,244 A | | 3/1991 | Osborne | 164/34 |
| 5,558,150 A | | 9/1996 | Sponseller | 164/95 |
| 5,579,822 A | * | 12/1996 | Darsy et al. | 164/95 |
| 5,762,969 A | | 6/1998 | Shimmell | 425/112 |
| 5,791,398 A | * | 8/1998 | Ono et al. | 164/306 |

FOREIGN PATENT DOCUMENTS

| | | |
|---|---|---|
| JP | 5358926 | 5/1978 |

* cited by examiner

*Primary Examiner*—Tom Dunn
*Assistant Examiner*—I.-H Lin
(74) *Attorney, Agent, or Firm*—Webb Ziesenheim Logsdon Orkin & Hanson, P.C.

(57) ABSTRACT

A compound cast product is formed in a casting mold (14) having a mold cavity (16) sized and shaped to form the cast product. A plurality of injectors (24) is supported from a bottom side (26) of the casting mold (14). The injectors (24) are in fluid communication with the mold cavity (16) through the bottom side (26) of the casting mold (14). A molten material holder furnace (12) is located beneath the casting mold (14). The holder furnace (12) defines molten material receiving chambers (36) configured to separately contain supplies of two different molten materials (37, 38). The holder furnace (12) is positioned such that the injectors (24) extend downward into the receiving chamber (36). The receiving chamber (36) is separated into at least two different flow circuits (51, 52). A first molten material (37) is received in a first flow circuit (51), and a second molten material (38) is received into a second flow circuit (52). The first and second molten materials (37, 38) are injected into the mold cavity (16) by the injectors (24) acting against the force of gravity. The injectors (24) are positioned such that the first and second molten materials (37, 38) are injected into different areas of the mold cavity (16). The molten materials (37, 38) are allowed to solidify and the resulting compound cast product is removed from the mold cavity (16).

18 Claims, 4 Drawing Sheets

COMPOUND CAST PRODUCT AND METHOD FOR PRODUCING A COMPOUND CAST PRODUCT

STATEMENT REGARDING FEDERALLY FUNDED RESEARCH

The subject matter of this application was made with United States government support under Contract No. 86X-SU545C awarded by the Department of Energy. The United States government has certain rights to this invention.

BACKGROUND OF THE INVENTION

1. Field of the Invention

The present invention relates to a cast product made of at least two different materials and, more particularly, a method for producing a compound cast product from different materials in a casting machine.

2. Description of the Prior Art

Component parts, such as automobile parts, are often used in circumstances where different portions of the component part are subjected to differing operating conditions. However, most casting apparatuses and methods for forming component parts yield cast structures that have similar, i.e., uniform, properties throughout. Thus, modulus of elasticity, strength, and other inherent properties of the component part do not vary significantly with location through the cast component part. However, it is often desirable to have different properties in different areas of a component part, such as the aforementioned automobile parts, which may be subjected to differing operating conditions. The following prior art references are known attempts to form component parts having different properties in different areas of the part.

U.S. Pat. No. 3,847,203 to Northwood discloses a sequential casting method for casting a component part made of two metal alloys. The component part is cast in a ceramic casting mold into which the two metal alloys are poured. In the method disclosed by the Northwood patent, a first metal alloy is poured into the casting mold and allowed to cool, but not completely solidify. Thereafter, a second metal alloy is poured into the casting mold on top of the first metal alloy and both metal alloys are allowed to cool. The resulting component part is thus formed of multiple metal layers.

U.S. Pat. No. 3,752,212 to Thompson discloses a similar "sequential" casting method to that disclosed by the Northwood patent for casting a component part made of two metal alloys. In the method disclosed by the Thompson patent, two different metals are poured into a casting mold in sequence. However, in the method disclosed by the Thompson patent the first poured metal alloy is permitted to cool and solidify before the second molten metal alloy is poured into the casting mold. The resulting component part is formed by multiple metal layers in a manner similar to the Northwood patent.

U.S. Pat. No. 5,762,969 to Shimmell discloses an apparatus for casting a tubular component part in multiple portions or layers. The casting apparatus disclosed by the Shimmell patent includes a mold assembly in which multiple "shots" of molten metal are poured sequentially into a mold cavity of the casting apparatus, which ultimately results in a component part made of multiple layers of metal. The tubular article is formed in a rotatable centrifugal casting mold.

U.S. Pat. No. 5,000,244 to Osborne discloses a lost foam casting apparatus for producing an automobile engine block. The casting apparatus disclosed by the Osborne patent is gravity fed and includes two inlets for supplying two different molten aluminum alloys to the mold cavity of the casting apparatus. The engine block casting is made by a lost foam process that employs an expendable pattern formed of expanded polystyrene. The pattern defines a first runner system for casting a first aluminum alloy and a second runner system for casting a second aluminum alloy in the mold cavity. The first and second aluminum alloys are independently, but concurrently, cast into a singular mold such that the entire engine block pattern is duplicated and an integral casting is formed.

U.S. Pat. No. 5,579,822 to Darsy et al. discloses a method for producing cast cylinder heads made of two different aluminum alloys. The method disclosed by the Darsy et al. patent requires the sequential pouring of two different molten aluminum alloys into the mold cavity of a casting apparatus. The molten aluminum alloys, upon solidification, form a cast cylinder head made of different layers of aluminum alloy.

The foregoing references each generally utilize a gravity flow arrangement to induce multiple molten metal alloys into a mold cavity of a casting apparatus. With such gravity flow arrangements it is difficult to control the mixing of the different molten metal alloys as they are fed into the mold cavity. In addition, such gravity flow in the arrangements often cause air pockets to form in the mold cavity, which weakens the resulting cast component part. Further, the pouring of molten aluminum alloys, in particular, into a casting mold under the force of gravity, often causes formation of undesirable metal oxides in the molten aluminum alloys.

In view of the foregoing, it is an object of the present invention to provide a method and apparatus for producing a cast product from at least two different materials such that the resulting cast product has different properties in different areas of the product. In addition, it is an object of the present invention to provide a method and apparatus for producing a cast product from at least two different materials such that the properties of the resulting cast product may be optimized in different areas of the cast product.

SUMMARY OF THE INVENTION

The above objects are accomplished with a method for producing a unitary compound cast product in accordance with the present invention. The method is practiced with a casting mold having a mold cavity sized and shaped to form the cast product. The casting mold has a bottom side. A plurality of injectors is supported from the bottom side of the casting mold. The injectors are in fluid communication with the mold cavity through the bottom side of the casting mold. A molten material holder furnace is located beneath the casting mold. The holder furnace defines a molten material receiving chamber configured to separately contain supplies of the at least two different molten materials. The holder furnace is positioned such that the injectors extend downward into the receiving chamber. The receiving chamber is separated into at least two different flow circuits for the at least two different molten materials. A first molten material is received in a first flow circuit in the receiving chamber. A second molten material is received in a second flow circuit in the receiving chamber. The first and second molten materials remain isolated from each other while in the receiving chamber. The first and second molten materials are injected separately into the mold cavity with the injectors. The injectors inject the first and second molten materials upward into the mold cavity against the force of gravity.

The injectors preferably inject the first and second molten materials into different areas of the mold cavity. The two flows join to form an interface of varied composition. The transition between the two materials will be relatively sharp. The first and second molten materials are preferably allowed to solidify in the mold cavity to form the joined compound cast product as a unitary body. The compound cast product may then be removed from the mold cavity of the casting mold.

The first and second molten materials may be metal alloys having different metallurgical properties. In addition, the first and second molten materials may be aluminum-based alloys, which may contain ceramic particulates.

The injectors may be piston-cylinder injectors. Thus, the method of the present invention may include the step of injecting the first and second molten materials into the mold cavity during an upstroke of the piston directed toward the bottom side of the casting mold. The first flow circuit may connect a first plurality of the injectors in series to one another. Likewise, the second flow circuit may connect a second plurality of the injectors in series to one another.

The method of the present invention may be practiced using two or more different molten materials. Accordingly, the method may further include the steps of receiving a third molten material into a third flow circuit formed in the receiving chamber, and separately injecting the third molten material into the mold cavity with at least one of the injectors. The third molten material preferably remains separated from the first and second molten materials while in the receiving chamber. At least one injector preferably injects the third molten material into a different area of the mold cavity from the first and second molten materials. At least two of the first, second, and third molten materials may be identical molten metal alloys. The first, second, and third molten materials may be aluminum-based molten metal alloys, which may contain ceramic particulates. All three materials join along interfaces where the three materials meet in the mold cavity. The present invention is also a unitary compound cast product formed of at least two different casting materials and made by the method generally described hereinabove.

Further details and advantages of the present invention will become apparent from the following detailed description read in conjunction with the drawings.

DETAILED DESCRIPTION OF THE PREFERRED EMBODIMENTS

Figure 1:
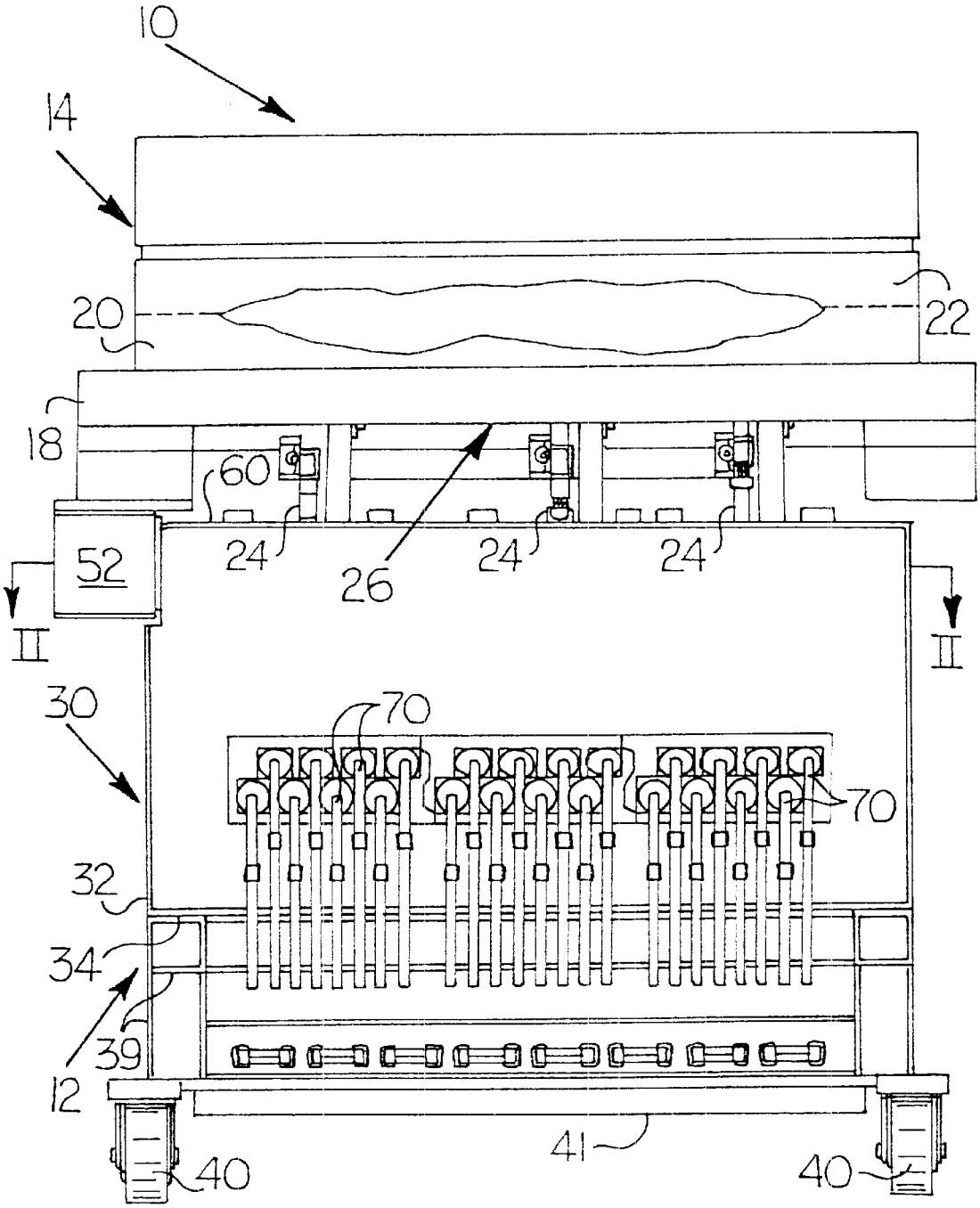
FIG. 1 is a side view of a casting machine used to produce a unitary cast product from different materials in accordance with the present invention.

FIG. 1 generally shows a casting machine 10 for casting a compound part or product in accordance with the present invention. A compound cast part made in accordance with the present invention will preferably be comprised of at least two different materials having different properties, such as two different strength aluminum alloys. The resulting "unitary" cast component part made in accordance with the present invention will thus have different properties in different areas of the part. For example, a portion of the resulting cast component part may have a higher mechanical strength than another portion of the cast component part. The following discussion references two metal alloys for the molten materials used to cast the component part for expediency in describing the present invention. However, the present invention is not limited to casting metal parts comprised of only two different metal alloys. The invention described hereinafter may be used to cast component parts comprised of more than two materials, such as three or more metal alloys. When three or more materials are cast as described herein, the present invention envisions that two or more of the materials may be identical. Further, the present invention envisions that additional materials, such as ceramic particulate, may be added to the molten materials (i.e., molten metal alloys), particularly when the molten materials are aluminum-based metal alloys. The use of ceramic particulate in the molten aluminum-based alloys allows the casting of component parts having regions comprised of composite containing ceramic particulate.

Referring now to FIGS. 1–4, the casting machine 10 for forming a compound. cast metal part in accordance with the present invention includes a molten metal holder furnace 12 and a molten metal casting mold 14 positioned above the holder furnace 12. The casting mold 14 defines a mold cavity 16 for casting the compound metal part. The resultant cast metal part, such as an automobile part, is preferably formed from at least two different metal alloys. The casting mold 14 and mold cavity 16 may be configured to cast ultra-large, thin-walled compound metal parts that may be used, for example, in a ground transportation vehicle. An ultra-large, thin-walled compound metal part for a ground transportation vehicle may have dimensions approaching or exceeding 3.0 meters long, 1.7 meters wide, and 0.4 meters in depth, and the mold cavity 16 of the casting mold 14 is preferably configured accordingly.

The casting mold 14 is preferably suitable for use with molten metal alloys having a low melting point, such as molten aluminum alloys. The casting mold 14 includes a holder frame 18 for supporting the casting mold 14. The casting mold 14 is generally defined by a lower die 20 and an upper die 22, which together define the mold cavity 16. The casting mold 14 is supported through the holder frame 18 by a support surface (not shown), or by other means customary in the art. The casting mold 14 is preferably located about one to two feet above the holder furnace 12. The casting mold 14 may further include a specially designed lower platen that extends downward from the holder frame 18. The lower platen (not shown) is a box-like structure, which extends downward from the holder frame 18 and encloses the upper portion of the holder furnace 12. The lower platen may extend downward about four to six feet.

The molten metal casting machine 10 further includes a plurality of molten metal injectors 24 supported from a bottom side 26 of the casting mold 14. The injectors 24 generally provide fluid communication between the mold cavity 16 and the interior of the holder furnace 12. The injectors 24 project downward from the bottom side 26 of the casting mold 14 into the holder furnace 12. The injectors 24 may be supported with conventional mechanical fasteners attached to the holder frame 18. The injectors 24, in a preferred embodiment of the present invention, operate against the force of gravity. The injectors 24 are preferably configured to provide low-pressure, hot chamber injection of molten metal contained in the holder furnace 12 into the mold cavity 16. Low-pressure, hot chamber injection is particularly well-suited for producing component metal parts made from non-ferrous metals having a low melting point, such as aluminum, brass, bronze, magnesium, and zinc. The molten metal casting machine 10 in accordance with the present invention is thus suitable for use in casting ultra-large, thin-walled component metal parts made of aluminum alloys. However, the casting machine 10 of the present invention is not limited to this particular application.

The holder furnace 12 used in the casting machine 10 will now be discussed in greater detail with reference to FIGS. 2–4. The holder furnace 12 is generally defined by a storage vessel 30 having sidewalls 32 and a bottom wall 34, which enclose a molten metal receiving chamber 36 of the holder furnace 12. The molten metal receiving chamber 36 is configured to contain at least two separate supplies of molten metal (i.e., two different materials) designated with reference numerals 37 and 38 in FIGS. 2–4. For example, the molten metal 37, 38 may be two different types of molten aluminum alloy. The separate supplies of molten metal are referred to hereinafter as first molten metal 37 and second molten metal 38. In a preferred embodiment, the molten metal receiving chamber 36 may be sized to contain a total capacity of about 1000 to 4000 pounds of molten metal.

The storage vessel 30 is preferably made of metal and, in particular, steel. The storage vessel 30 includes a base support structure 39 for supporting the holder furnace 12. The support structure 39 includes wheels 40, which make the holder furnace 12 transportable. Accordingly, the holder furnace 12 may be easily replaced in the molten metal casting machine 10. A lift device 41 may be located beneath the support structure 39 of the holder furnace 12 for lifting the holder furnace 12 into engagement with the injectors 24 extending downward from the bottom side 26 of the casting mold 14. The lift device 41 may be a jack screw device or a hydraulic lift mechanism, as examples.

The holder furnace 12 includes a plurality of furnace lining layers 42 lining the molten metal receiving chamber 36. In a preferred embodiment of the holder furnace 12, three furnace lining layers 42 line the molten metal receiving chamber 36. A first layer 44 of the furnace lining layers 42 lies immediately adjacent and in contact with the sidewalls 32 and bottom wall 34 of the storage vessel 30. The first layer 44 is preferably a thermal insulation layer and may have a thickness of about one to three inches. The first layer 44 is preferably a microporous, primarily pressed silica powder (50–90%) material that is encapsulated in a woven fiberglass cloth. A suitable thermal insulating material for the first layer 44 includes Microtherm manufactured by Microtherm Inc., Maryville, Tenn.

A second layer 46 is positioned radially inward from the first layer 44 and is in contact therewith. The second layer 46 is preferably an aluminum-resistant, insulating, and castable material. The second layer 46 may be comprised of primarily silica and alumina, and is preferably light in weight and possesses low thermal conductivity properties. A suitable aluminum-resistant, lightweight, insulating, and castable material for the second layer 46 may include approximately 35% silica and 45% alumina by weight. A suitable aluminum-resistant, lightweight, insulating, and castable material for the second layer 46 includes ALSTOP™ Lightweight Castable manufactured by A. P. Green, Minerva, Ohio.

A third layer 48 of the furnace lining layers 42 lies radially inward from the second layer 46 and is in contact therewith. The third layer 48 is preferably a high alumina content castable layer. For example, the third layer 48 may include about 80% alumina by weight. A suitable material for the third layer 48 includes Grefcon™ 80A manufactured by RHI Refractories America having an alumina content of about 80% by weight. The furnace lining layers 42 generally separate the sidewalls 32 and bottom wall 34 of the storage vessel 30 from the molten metal contained in the molten metal receiving chamber 36.

The surface of the molten metal receiving chamber 36 is preferably formed by a sealing layer 50. The sealing layer 50 is preferably an alumina fiber mat material that lines the molten metal receiving chamber 36. A suitable material for the sealing layer 50 is sold under the trademark SAFIL™ Alumina LD Mat and is manufactured by Thermal Ceramics, Augusta, Ga. The sealing layer 50 may, for example, include about 90–96% alumina fibers by weight.

The holder furnace 12 further includes at least two separate molten metal flow circuits 51, 52 providing flow paths through the holder furnace 12 for the first and second molten metals 37, 38, respectively. The holder furnace 12 and, more particularly, the first and second molten metal flow circuits 51, 52 are preferably in fluid communication with one or more externally located main melter furnaces (not shown). The main melter furnace (or furnaces) is used to supply the holder furnace 12 and the molten metal circuits 51, 52 with flows of the first and second molten metals 37, 38. The main melter furnace preferably segregates the first and second molten metals 37, 38 such that the first and second molten metal flow circuits 51, 52 are separately supplied with different molten metal alloys. The main melter furnace typically contains a large quantity of molten metal in comparison to the holder furnace 12, and may have as much as about 30,000 pounds of molten metal, as an example.

As will be appreciated by those skilled in the art, the holder furnace 12 may contain any number of molten metal flow circuits and is not limited to the first and second molten metal flow circuits 51, 52 described hereinabove. For example, three molten metal flow circuits may be formed within the molten metal receiving chamber 36. The main melter furnace (or furnaces) would then preferably be configured to separately supply three different molten metal alloys to the three respective molten metal flow circuits. With such an arrangement, all three of the molten metal flow circuits may contain different molten metal alloys, the same molten metal alloy, or any chosen two of the molten metal flow circuits may contain the same molten metal alloy. The main melter furnace may also provide the same molten metal alloy to each of the first and second molten metal flow circuits 51, 52 in the embodiment of the present invention illustrated in the FIGURES.

In operation, the first and second molten metals 37, 38 flow from the main melter furnace (or furnaces) into the holder furnace 12 through the respective first and second molten metal flow circuits 51, 52. The first and second molten metals 37, 38 flow continuously between the main melter furnace and the holder furnace 12 through the first and second molten metal flow circuits 51, 52. Thus, "clean" supplies of the first and second molten metals 37, 38 are always present in the holder furnace 12 because of the continuous circulation of molten metal between the main melter furnace and the holder furnace 12.

Figure 2:
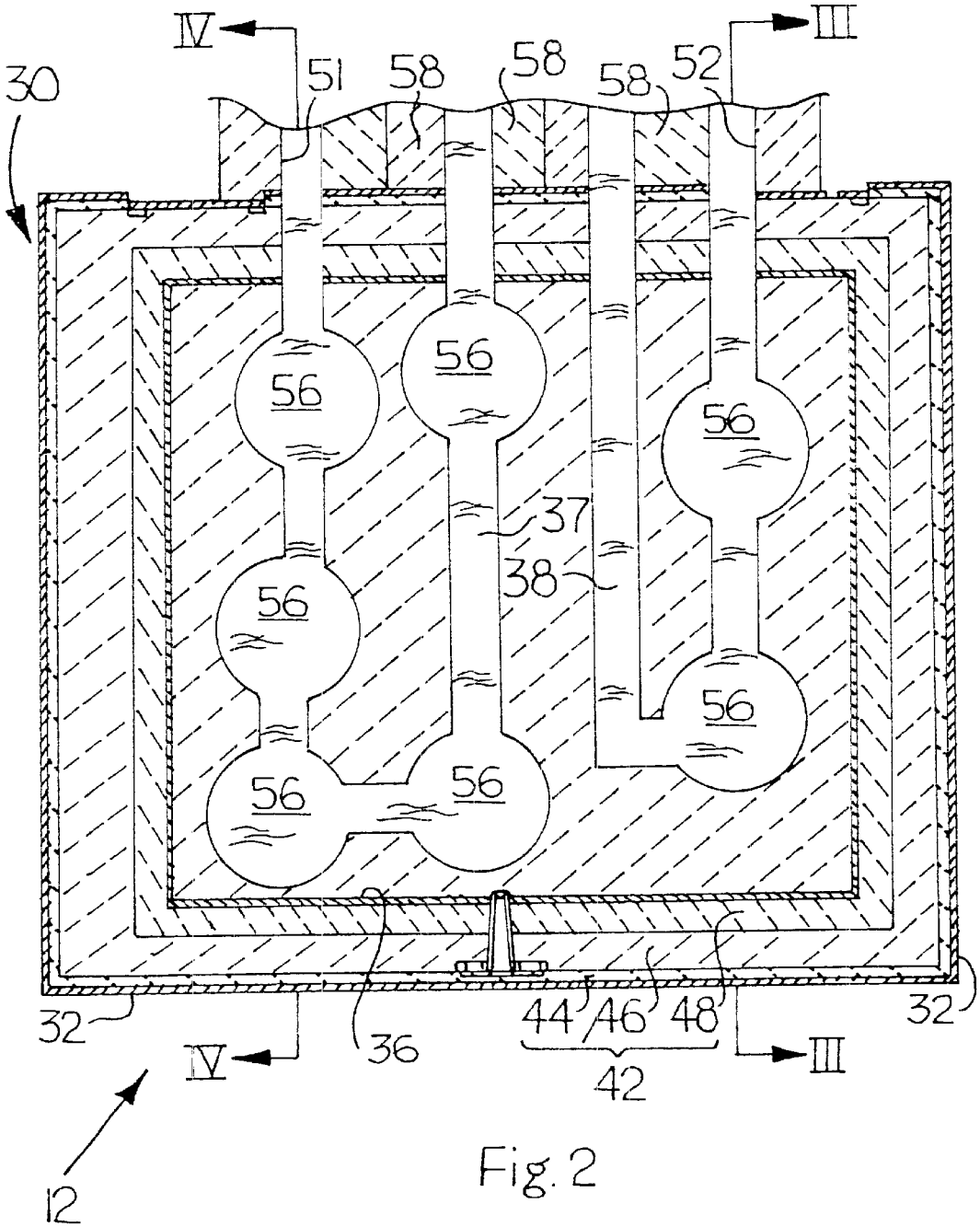
FIG. 2 is a cross-sectional top view of a holder furnace used in the casting machine of FIG. 1 taken along lines II—II in FIG. 1.
Figure 3:
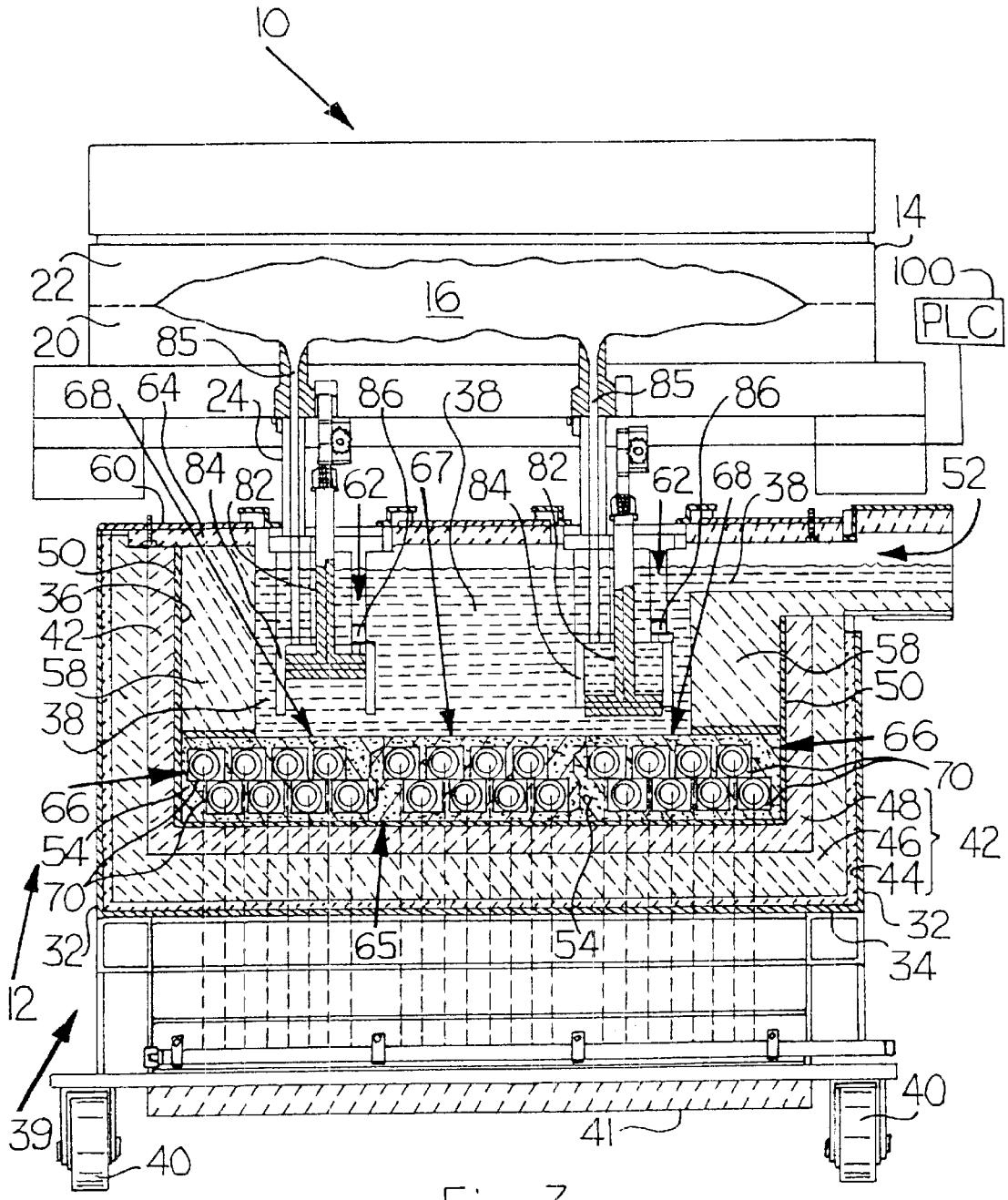
FIG. 3 is a cross-sectional side view of the holder furnace used in the casting machine of FIG. 1 taken along lines III—III in FIG. 2.
Figure 4:
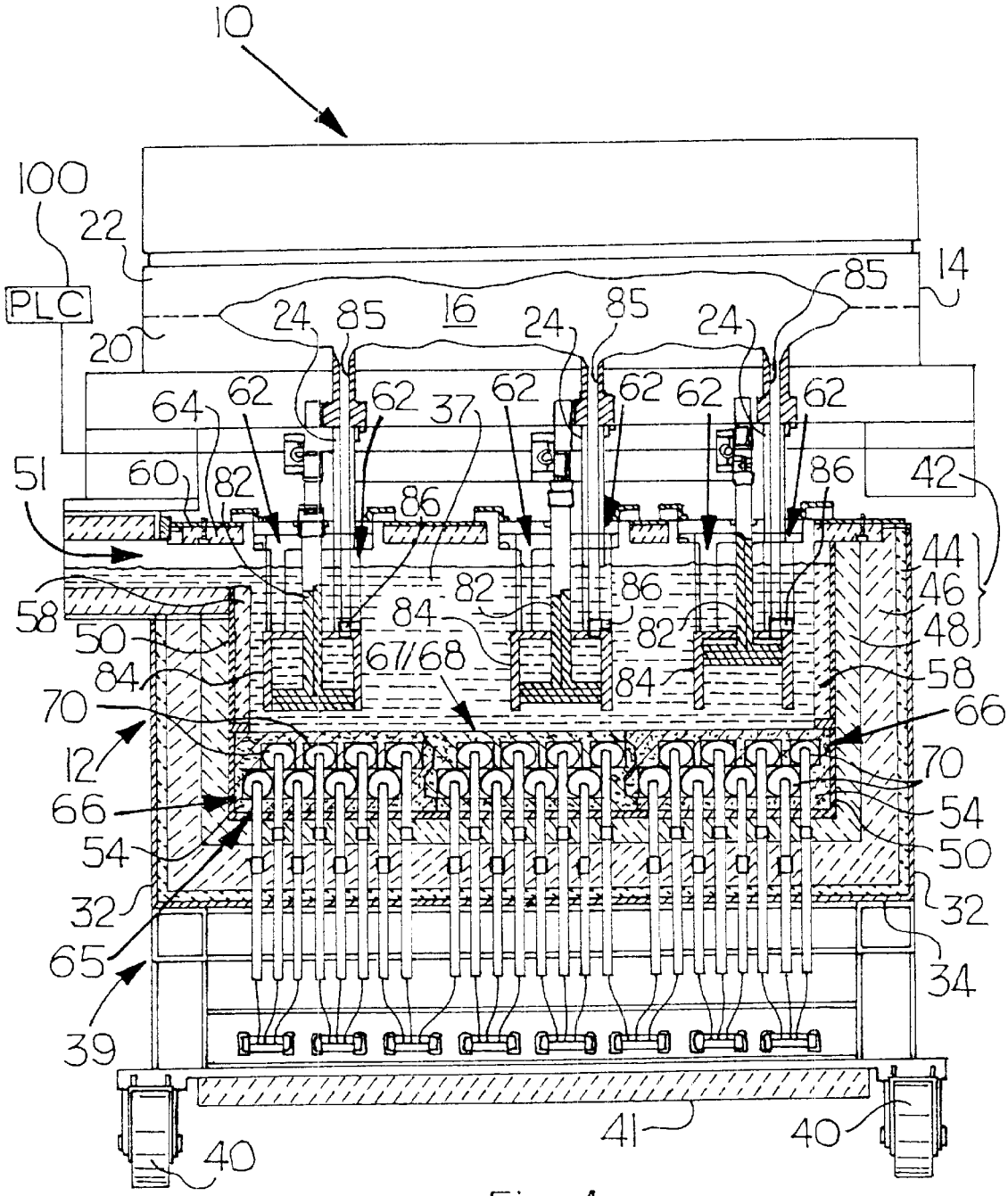
FIG. 4 is a cross-sectional side view of the holder furnace used in the casting machine of FIG. 1 taken along lines IV—IV in FIG. 2.

As shown in FIGS. 3 and 4, the holder furnace 12 includes a plurality of heat exchanger blocks 54 located at the bottom of the molten metal receiving chamber 36. The heat exchanger blocks 54 are used to heat the first and second molten metals 37, 38 flowing through the molten metal receiving chamber 36. A plurality of vertically extending injector receiving chambers 56 is preferably formed within the molten metal receiving chamber 36 and on top of the heat exchanger blocks 54. The injector receiving chambers 56 are preferably formed as part of the first and second molten metal flow circuits 51, 52. The injectors 24 are omitted from FIG. 2 for clarity in viewing the injector receiving chambers 56 and the first and second molten metal flow circuits 51, 52.

The injector receiving chambers 56 are formed by a layer of refractory material 58 located on top of the heat exchanger blocks 54. The layer of refractory material 58 is preferably suitable for use with molten aluminum alloys. Suitable refractory materials include Permatech™ Sigma or Beta II castable refractory materials manufactured by Permatech Inc., Graham, N.C. Permatech™ Sigma refractory material is comprised of about 64% silica, 30% calcium aluminate cement, and 6% chemical frits by weight, and Permatech™ Beta II refractory material is comprised primarily of about 62% alumina and 29% silica by weight. The injector receiving chambers 56 are preferably sized to accommodate the injectors 24 supported from the bottom side 26 of the casting mold 14. In particular, when the holder furnace 12 is lifted into engagement with the injectors 24 by the lift device 41, the injectors 24 are received, respectively, into the injector receiving chambers 56. As shown in FIG. 2, the injector receiving chambers 56 in each of the first and second molten metal flow circuits 51, 52 are connected together in series. Thus, the layer of refractory material 58 generally defines the injector receiving chambers 56 and the flow paths (flow circuits 51, 52) connecting these chambers. In operation, the first and second molten metals 37, 38 flow sequentially into each of the injector receiving chambers 56 from the main melter furnace and then return to the main melter furnace.

The present invention also envisions that the holder furnace 12 may be a "batch" type furnace. Accordingly, the injector receiving chambers 56 may be filled with a "batch" of the respective first and second molten metals 37, 38 from an external source, such as the aforementioned main melter furnace, and the casting process continued as discussed hereinafter. Recirculation of the first and second molten metals 37, 38 to the melter furnace would not be necessary with such a "batch" type arrangement.

A furnace cover 60 is positioned on top of the storage vessel 30 to substantially enclose the molten metal receiving chamber 36. The furnace cover 60 preferably includes a plurality of openings 62 corresponding to the plurality of vertically extending injector receiving chambers 56 for receiving, respectively, the injectors 24 into the injector receiving chambers 56. The furnace cover 60 may be made of metal, such as steel, and preferably includes an insulating layer 64 facing the molten metal receiving chamber 36 to protect the furnace cover 60 from contact with the molten metal contained in the molten metal receiving chamber 36. The insulating layer 64 is preferably an insulating blanket material. The insulating blanket material protects the furnace cover 60 from warping because of the high heat of the first and second molten metals 37, 38 in the molten metal receiving chamber 36. Suitable materials for the insulating material include any of the materials discussed previously in connection with the furnace lining layers 42, such as Microtherm, ALSTOP™ Lightweight Castable, and Grefcon™ 80A, or another substantially equivalent material. Another suitable material for the insulating layer 64 includes Maftec™ manufactured by Thermal Ceramics Inc., Augusta, Ga. This material is a heat storage multi-fiber blanket material that is heat resistant to about 2900° F.

As stated previously, the holder furnace 12 includes one or more heat exchanger blocks 54 which are located at the bottom of the molten metal receiving chamber 36. The heat exchanger blocks 54 are used to heat the first and, second molten metals 37, 38 flowing through the molten metal receiving chamber 36. The heat exchanger blocks 54 are thermally conductive and are preferably made of graphite, silicon carbide, or another material having similar thermally conductive properties. The heat exchanger blocks 54 may be connected together along longitudinal side or end edges by a tongue-in-groove connection as shown, for example, in FIGS. 3 and 4. A preferred tapered angle of the tongue-in-groove connection is about 5°. The heat exchanger blocks 54 may be provided as a single, large heat exchanger block having dimensions conforming to the size of the molten metal receiving chamber 36, or multiple blocks as stated hereinabove. The discussion hereinafter refers to a single heat exchanger block 54 for clarity.

In addition to forming the surface of the molten metal receiving chamber 36, the sealing layer 50, discussed previously, preferably also partially covers or encloses the heat exchanger block 54. In particular, the sealing layer 50 preferably covers the heat exchanger block 54 on a bottom face 65 and side faces 66 of the heat exchanger block 54, and may cover portions of a top face 67 of the heat exchanger block 54 located under the layer of refractory material 58 forming the injector receiving chambers 56. The remaining, "exposed" portions of the top face 67 of the heat exchanger block 54 define heat transfer surfaces 68 of the heat exchanger block 54, as shown in FIGS. 3 and 4. The heat transfer surfaces 68 are exposed areas along the top face 67 of the heat exchanger block 54 intended for direct contact with the first and second molten metals 37, 38 flowing through the injector receiving chambers 56. The heat transfer surfaces 68 transfer heat from the heat exchanger block 54 to the first and second molten metals 37, 38 flowing through the molten metal receiving chamber 36. Thus, the heat transfer surfaces 68 substantially coincide with the first and second molten metal flow circuits 51, 52 and the injector receiving chambers 56.

The sealing layer 50 may be omitted entirely from the top face 67 of the heat exchanger block 54 if the first and second molten metal flow circuits 51, 52 are not formed in the molten metal receiving chamber 36. In this situation, the entire top face 67 of the heat exchanger block 54 is exposed and used to transfer heat to the molten metal received within the molten metal receiving chamber 36. Further, with this type of an arrangement the entire molten metal receiving chamber 36 is divided into separate, isolated molten metal holding areas, which separate the first and second molten metals 37, 38 from contact with each other. The separate holding areas within the molten metal receiving chamber 36 are separately supplied with molten metal from the main melter furnace as substantially described previously. In other words, specific molten metal flow paths are not formed within the holder furnace 12, but the holder furnace 12 is segregated into separate "baths" of molten metal.

In summary, in a preferred embodiment of the present invention, the sealing layer 50 generally separates the bottom face 65 and side faces 66 of the heat exchanger block 54 from contact with the furnace lining layers 42. Further, the sealing layer 50 is used to separate portions of the top face 67 of the heat exchanger block 54 from contact with the layer of refractory material 58 forming the injector receiving chambers 56 and, further, the first and second molten metal flow circuits 51, 52.

The heat exchanger block 54 further includes a plurality of electrical heaters 70 which are used to heat the heat exchanger block 54 and, further, the first and second molten metals 37, 38 flowing through the first and second molten metal flow circuits 51, 52. The embodiment of the holder furnace 12 shown in FIGS. 1 and 2 includes a total of twenty-four electrical heaters 70. Thus, the three heat exchanger blocks 54 shown in FIGS. 3 and 4 each include eight electrical heaters 70. However, it will be appreciated by those skilled in the art that the respective heat exchanger blocks 54 may include any number of electrical heaters 70. The electrical heaters 70 may, for example, be resistive-type electrical heaters that extend completely or partially through the respective heat exchanger blocks 54. For aluminum alloy applications, the electrical heaters 70 are preferably sized to maintain a system molten metal temperature of between about 1300–1500° F., and preferably about 1400° F.

Referring to FIGS. 1–4, operation of the casting machine 10 for casting a compound metal part in accordance with the present invention will now be discussed. FIG. 2 shows an exemplary and nonexclusive configuration of the first and second molten metal flow circuits 51, 52 in the holder furnace 12. In the configuration shown in FIG. 2, the first molten metal flow circuit 51 connects five of the injector receiving chambers 56 in series. Similarly, the second molten metal flow circuit 52 connects two of the injector receiving chambers 56 in series. However, the physical layout of the first and second molten metal flow circuits 51, 52 and the number of injector receiving chambers 56 provided in the respective circuits may be changed as necessary to meet the design criteria of the cast metal part to be formed in the casting machine 10. The first and second molten metal flow circuits 51, 52, as discussed previously, receive flows of the first and second molten metals 37, 38 from the main melter furnace (or furnaces). The individual injector receiving chambers 56 in fluid communication with the first and second molten metal flow circuits 51, 52 are preferably filled to a substantially constant and predefined operating level with molten metal. Preferably, continuous flows of the first and second molten metals 37, 38 flow through the first and second molten metal flow circuits 51, 52 and maintain set molten metal operating levels in the injector receiving chambers 56.

The holder furnace 12 is preferably positioned beneath the casting machine 10 such that the injectors 24 are received within the injector receiving chambers 56. Thus, the five injectors 24 in the first molten metal flow circuit 51 are in fluid communication with a continuous flow of the first molten metal 37. Likewise, the two injectors 24 in the second molten metal flow circuit 52 are in fluid communication with a continuous flow of the second molten metal 38.

The injectors 24 are preferably piston-cylinder injectors, each having a piston 82 and cylinder 84. The injectors 24 are preferably in fluid communication with the mold cavity 16 through respective injection tubes 85 passing through the bottom side of the casting mold 14. The injectors 24 are preferably oriented such that the piston 82 of each of the injectors 24 is substantially perpendicular to the bottom side 26 of the casting mold 14. The injectors 24 preferably each include an inlet valve 86 (i.e., on/off valve) that is configured to open during a downstroke of the piston 82 directed away from the bottom. side 26 of the casting mold 14 to allow molten metal present in the injector receiving chambers 56 to flow into and substantially fill the cylinders 84. Thus, the downstroke of the piston 82 is the "fill" stroke of the piston 82 in accordance with the above-defined convention. The inlet valve 86 is preferably configured to close during the return stroke of the piston 82 toward the bottom side 26 of the casting mold 14. Thus, the return stroke of the piston 82 toward the bottom side 26 of the casting mold 14 is the "injection" stroke of the injectors 24. The inlet valve 86 may be a simple on/off valve or a check valve.

An injection cycle of the casting machine 10 may commence once the injectors 24 operating in the respective first and second molten metal flow circuits 51, 52 are filled with molten metal. Thereafter, the injectors 24 may be operated to move through a return stroke to inject a supply of the first molten metal 37 into a portion of the mold cavity 16 and inject a supply of the second molten metal 38 into another portion of the mold cavity 16. Multiple injections of molten metal may be made with the injectors 24 to fill the mold cavity 16. The first and second molten metals 37, 38 are thus injected into the mold cavity 16 against the force of gravity and preferably under low pressure on the order of 5 to 15 psi. The injected supplies or "flows" of the first and second molten metals 37, 38 mix at the interface formed by the meeting of the two materials (i.e., the first and second molten metals 37, 38).

The entire mold cavity 16 is preferably filled with the first and second molten metals 37, 38 after single or repeated injection cycles, i.e., return strokes, of the injectors 24. The first and second molten metals 37, 38 are then allowed to cool and solidify to form a unitary, compound cast metal part in accordance with the present invention. The resultant unitary cast metal part will have a portion comprised of one type of metal and a portion comprised of a second type of metal, with a boundary area comprised of a "mix" of the two different metals. Thus, the resultant unitary cast metal part will have varying properties along its length.

A programmable logic controller 100 preferably individually controls the injectors 24 operating in each of the first and second molten metal flow circuits 51, 52. Thus, the five injectors 24 operating in the first molten metal flow circuit 51 and the two injectors operating in the second molten metal flow circuit 52 may be controlled to operate simultaneously or sequentially by the controller 100. For example, the controller 100 may be programmed such that the injectors 24 may be sequenced at different times and at different rates to supply the first and second molten metals 37, 38 at different times and at different rates to the mold cavity 16. It will be apparent that the shape of the mold cavity 16 for many cast parts will have areas of large and small volumes. Accordingly, the present invention envisions that the rates at which the first and second molten metals 37, 38 are injected into the mold cavity 16 may be controlled by the controller 100 to uniformly fill the mold cavity 16. For example, it may be advantageous to sequence the injection of the first molten metal 37 flowing through the first molten metal flow circuit 51 before the injection of the second molten metal 38 flowing through the second molten metal flow circuit 52. For example, the volume to be occupied by the first molten metal 37 in the mold cavity 16 may be greater than the volume to be occupied by the second molten metal 38 in the mold cavity 16.

Further, the controller 100 may be used in a situation where it is desired that most of a metal part be made of a particular type of metal alloy while only a small portion of the metal part be made of another type of metal alloy. The controller 100 may be used to control the injection of the first and second molten metals 37, 38 to achieve this result. Controlling the flow rates into the mold cavity 16 will also help ensure that the mold cavity 16 is entirely filled with molten metal to prevent the formation of air pockets within the mold cavity 16 and, therefore, the resultant cast part.

In view of the forgoing, the casting machine and method described hereinabove may used to produce cast products having different properties in different areas of the product. The "recirculating" molten material supply system described previously advantageously provides continuous and "clean" supplies of different types of molten material to the holder furnace. The respective molten materials supplied to the holder furnace and ultimately to the casting mold of the casting machine may be selected to optimize the properties of the resultant cast product. The number of injectors and the configuration of the injector receiving chambers and, more particularly, the flow path connecting these chambers may be changed to suit the specific design criteria of the compound part to be cast. A potentially infinite number of shapes for the component parts could be made using the casting machine and method described hereinabove.

While preferred embodiments of the present invention were described herein, various modifications and alterations of the present invention may be made without departing from the spirit and scope of the present invention. The scope of the present invention is defined in the appended claims and equivalents thereto.

We claim:

1. A method for producing a compound cast product from at least two different casting materials, comprising the steps of:

providing a casting mold having a mold cavity sized and shaped to form the cast product, with the casting mold having a bottom side;

supporting a plurality of injectors from the bottom side of the casting mold, with the injectors in fluid communication with the mold cavity through the bottom side of the casting mold;

locating a molten material holder furnace beneath the casting mold, with the holder furnace defining a molten material receiving chamber configured to separately contain supplies of the at least two different molten materials, with the holder furnace positioned such that the injectors extend downward into the receiving chamber, and with the receiving chamber separated into at least two different flow circuits for the at least two different molten materials;

receiving a first molten material into a first flow circuit in the receiving chamber;

receiving a second molten material into a second flow circuit in the receiving chamber, with the first and second molten materials remaining separated from each other while in the receiving chamber; and separately injecting the first and second molten materials into different areas of the mold cavity with injectors, with the injectors injecting the first and second molten materials upward into the mold cavity against the force of gravity.

2. The method of claim 1, wherein the first and second molten materials are metal alloys having different metallurgical properties.

3. The method of claim 1, wherein the first and second molten materials are aluminum-based metal alloys.

4. The method of claim 3, wherein the aluminum-based metal alloys include ceramic particulates.

5. The method of claim 1, wherein the injectors are piston cylinder injectors, and wherein the method farther comprises the step of injecting the first and second molten materials into the mold cavity during the upstroke of the piston directed toward the bottom side of the casting mold.

6. The method of claim 1, wherein the first flow circuit connects a first plurality of the injectors in series to one another, and wherein the second flow circuit connects a second plurality of the injectors in series to one another.

7. The method of claim 1, further comprising the steps of:

receiving a third molten material into a third flow circuit formed in the receiving chamber, with the third molten material remaining separated from the first and second molten materials while in the receiving chamber; and separately injecting the third molten material into the mold cavity with at least one of the injectors.

8. The method of claim 7, wherein the at least one injector injects the third molten material into a different area of the mold cavity from the first and second molten materials.

9. The method of claim 7, wherein at least two of the first, second, and third molten materials are identical molten metal alloys.

10. A method for producing a compound cast product from at least two different casting materials, comprising the steps of:

providing a casting mold having a mold cavity sized and shaped to form the cast product, with the casting mold having a bottom side;

supporting a plurality of injectors from the bottom side of the casting mold, with the injectors in fluid communication with the mold cavity through the bottom side of the casting mold;

locating a molten material holder furnace beneath the casting mold, with the holder furnace defining a molten material receiving chamber configured to separately contain supplies of the at least two different molten materials, with the holder furnace positioned such that the injectors extend downward into the receiving chamber, and with the receiving chamber separated into at least two different flow circuits for the at least two different molten materials;

receiving a first molten material into a first flow circuit in the receiving chamber;

receiving a second molten material into a second flow circuit in the receiving chamber, with the first and second molten materials remaining separated from each other while in the receiving chamber;

separately injecting the first and second molten materials into different areas of the mold cavity with the injectors, with the injectors injecting the first and second molten materials upward into the mold cavity against the force of gravity;

solidifying the first and second molten materials within the mold cavity to form the compound cast product as a unitary body; and removing the compound cast product from the mold cavity.

11. The method of claim 10, wherein the first and second molten. materials are metal alloys having different metallurgical properties.

12. The method of claim 10, wherein the first and second molten materials are aluminum-based metal alloys.

13. The method of claim 12, wherein the aluminum-based metal alloys include ceramic particulates.

14. The method of claim 10, wherein the injectors are piston-cylinder injectors, and wherein the method further comprises the step of injecting the first and second molten materials into the mold cavity during the upstroke of the piston directed toward the bottom side of the casting mold.

15. The method of claim 10, wherein the first flow circuit connects a first plurality of the injectors in series to one another, and wherein the second flow circuit connects a second plurality of the injectors in series to one another.

16. The method of claim 10, further comprising the steps of:

receiving a third molten material into a third flow circuit formed in the receiving chamber, with the third molten material remaining separated from the first and second molten materials while in the receiving chamber; and separately injecting the third molten material into the mold cavity with at least one of the injectors.

17. The method of claim 16, wherein at least two of the first, second, and third molten materials are identical molten metal alloys.

18. The method of claim 16, wherein the first, second, and third molten materials are aluminum-based molten metal alloys.

* * * * *

UNITED STATES PATENT AND TRADEMARK OFFICE

CERTIFICATE OF CORRECTION

PATENT NO. : 6,450,237 B1
DATED : September 17, 2002
INVENTOR(S) : Thomas N. Meyer et al.

It is certified that error appears in the above-identified patent and that said Letters Patent is hereby corrected as shown below:

Title page,
Item [73], Assignee, insert -- Alcoa Inc., Pittsburgh, PA (US) --

Column 4,
Line 26, "compound. cast" should read -- compound cast --.

Column 9,
Line 64, "bottom. side" should read -- bottom side --.

Column 11,
Line 64, "method farther" should read -- method further --.

Column 12,
Line 57, "molten." should read -- molten --.

Signed and Sealed this

Twelfth Day of August, 2003

JAMES E. ROGAN
*Director of the United States Patent and Trademark Office*